US009217289B2

(12) United States Patent
Moriarty et al.

(10) Patent No.: US 9,217,289 B2
(45) **Date of Patent: *Dec. 22, 2015**

(54) CASING DRILLING BOTTOM HOLE ASSEMBLY HAVING WIRELESS POWER AND DATA CONNECTION

(71) Applicant: Schlumberger Technology Corporation, Sugar Land, TX (US)

(72) Inventors: Keith A. Moriarty, Houston, TX (US); Raphael Gadot, Houston, TX (US); Brian Oliver Clark, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 146 days.

This patent is subject to a terminal disclaimer.

(21) Appl. No.: 13/797,502

(22) Filed: Mar. 12, 2013

(65) Prior Publication Data

US 2014/0090898 A1 Apr. 3, 2014

Related U.S. Application Data

(60) Provisional application No. 61/704,630, filed on Sep. 24, 2012, provisional application No. 61/704,805, filed on Sep. 24, 2012, provisional application No. 61/704,758, filed on Sep. 24, 2012.

(51) Int. Cl.
*E21B 47/12* (2012.01)
*E21B 7/04* (2006.01)
(Continued)

(52) U.S. Cl.
CPC ... *E21B 7/04* (2013.01); *E21B 7/20* (2013.01); *E21B 41/0085* (2013.01); *E21B 47/122* (2013.01); *E21B 47/182* (2013.01)

(58) Field of Classification Search
CPC ..... E21B 17/00; E21B 17/02; E21B 44/00; E21B 47/00; E21B 47/12; E21B 47/13; E21B 47/18; G01N 27/02
See application file for complete search history.

(56) References Cited

U.S. PATENT DOCUMENTS 5,394,951 A 3/1995 Pringle et al.
6,047,784 A 4/2000 Dorel
(Continued)

FOREIGN PATENT DOCUMENTS

RU 2213370 C2 9/2003
RU 2305183 C2 8/2007

OTHER PUBLICATIONS

International Search Report and the Written Opinion for International Application No. PCT/US2013/061135 dated Jan. 10, 2014.

*Primary Examiner* — William P Neuder
(74) *Attorney, Agent, or Firm* — John Vereb

(57) ABSTRACT

Various embodiments of methods and systems for wireless power and/or data communications transmissions to a sensor subassembly above a mud motor in a bottom hole assembly are disclosed. Power and/or data are supplied by rotary modulator and power generation system positioned above the mud motor. Wires may connect to an annular coil. Power and/or communications are transmitted through the annular coil to an inductively coupled second, mandrel coil that is attached to the rotor. By leveraging resonantly tuned circuits and impedance matching techniques for the coils, power and/or data can be transmitted efficiently from one coil to the other despite relative movement and misalignment of the two coils.

15 Claims, 17 Drawing Sheets

(51) Int. Cl.

| | |
|---|---|
| ***E21B 41/00*** | (2006.01) |
| ***E21B 47/18*** | (2012.01) |
| ***E21B 7/20*** | (2006.01) |

(56) References Cited

U.S. PATENT DOCUMENTS

| | | | |
|---|---|---|---|
| 6,392,561 | B1 | 5/2002 | Davies et al. |
| 6,419,014 | B1 | 7/2002 | Meek et al. |
| 6,427,783 | B2 | 8/2002 | Krueger et al. |
| 7,190,084 | B2 | 3/2007 | Hall et al. |
| 7,552,761 | B2 | 6/2009 | Moriarty |
| 7,591,304 | B2 | 9/2009 | Juhasz et al. |
| 7,666,668 | B2 | 2/2010 | Bujard et al. |
| 8,146,679 | B2 | 4/2012 | Downton |
| 8,408,333 | B2 | 4/2013 | Pai et al. |
| 2004/0094303 | A1 | 5/2004 | Brockman et al. |
| 2005/0252688 | A1 | 11/2005 | Head et al. |
| 2006/0054354 | A1 | 3/2006 | Orban |
| 2006/0260806 | A1 | 11/2006 | Moriarty |
| 2007/0261887 | A1 | 11/2007 | Pai et al. |
| 2008/0277163 | A1 | 11/2008 | Moriarty |
| 2010/0018770 | A1 | 1/2010 | Moriarty et al. |
| 2014/0083768 | A1 * | 3/2014 | Moriarty et al. ..... 175/40 |

* cited by examiner

1900

$$S=S_o \exp[-4\pi f(D/d)^2(\mu/K)]$$

where

S=signal strength at a surface transducer;

$S_o$=signal strength at the downhole modulator;

f=carrier frequency of the MWD signal expressed in Hertz;

D=measured depth between the surface transducer and the downhole modulator;

d=inside diameter of the drill pipe (same units as measured depth);

$\mu$=plastic viscosity of the drilling fluid; and

K=bulk modulus of the volume of mud above the modulator, and by the modulator signal pressure relationship $$S_o (\rho_{mud} \times Q^2)/A^2$$

where $S_o$=signal strength at the downhole modulator;

$\rho_{mud}$=density of the drilling fluid;

Q=volume flow rate of the drilling fluid; and

A=the flow area with the modulator in the "closed" position, a function of the gap setting.

FIG. 19

CASING DRILLING BOTTOM HOLE ASSEMBLY HAVING WIRELESS POWER AND DATA CONNECTION

CROSS-REFERENCE TO RELATED APPLICATIONS

This application claims the benefit of and priority to U.S. Provisional Patent Application Ser. No. 61/704,630, entitled "Casing Drilling Bore Hole Assembly With A Wireless Power and Data Connection," and filed on Sep. 24, 2012, U.S. Provisional Patent Application Ser. No. 61/704,805, entitled "System And Method For Wireless Power And Data Transmission In A Mud Motor," and filed on Sep. 24, 2012, and U.S. Provisional Patent Application Ser. No. 61/704,758, entitled "Positive Displacement Motor Rotary Steerable System And Apparatus," and filed on Sep. 24, 2012, the disclosures of which are hereby incorporated by reference in their entireties.

DESCRIPTION OF THE RELATED ART

During conventional measuring while drilling (MWD) or logging while drilling (LWD) operations, signals are passed between a surface unit and the BHA to transmit, for example commands and information. Typical telemetry systems involve mud-pulse telemetry that uses the drill pipe as an acoustic conduit for mud pulse telemetry. With mud pulse telemetry, mud is passed from a surface mud pit and through the pipes to the bit. The mud exits the bit and is used to contain formation pressure, cool the bit, and lift drill cuttings from the borehole. This same mud flow is selectively altered to create pressure pulses at a frequency detectable at the surface and downhole. Typically, the operating frequency is in the order 1-3 bits/sec, but can fall within the range of 0.5 to 6 bits/sec.

In conventional drilling, a well is drilled to a selected depth with drill pipe, and then the wellbore is typically lined with a larger-diameter pipe, usually called casing. Casing typically includes casing sections connected end-to-end, similar to the way drill pipe is connected. To accomplish this, the drill string and the drill bit are removed from the borehole in a process called "tripping." Once the drill string and bit are removed, the casing is lowered into the well and cemented in place. The casing protects the well from collapse and isolates the subterranean formations from each other. After the casing is in place, drilling may continue or the well may be completed depending on the situation.

Conventional drilling typically includes a series of drilling, tripping, casing and cementing, and then drilling again to deepen the borehole. This process is very time consuming and costly. Additionally, other problems are often encountered when tripping the drill string. For example, the drill string may get caught up in the borehole while it is being removed. These problems require additional time and expense to correct.

The term "casing drilling" refers to the use of a casing string in place of a drill string which uses drill pipe. Like the drill string, a chain of casing sections are connected end-to-end to form a casing string. The BHA and the drill bit are connected to the lower end of a casing string, and the well is drilled using the casing string to transmit drilling fluid, as well as axial and rotational forces, to the drill bit. Upon completion of drilling, the casing string may then be cemented in place to form the casing for the wellbore. Casing drilling enables the well to be simultaneously drilled and cased.

Existing casing drilling systems that employ directional MWD and/or LWD assemblies have several drawbacks. A downhole drilling motor is typically used due to rotational limitations of the casing and provides power for rotation of the BHA, including the bit to drill the pilot hole and the under-reamer to enlarge the hole for the casing to pass. The downhole drilling motor typically includes a positive displacement mud motor (PDM) or turbodrill. In a directional/logging BHA for casing drilling, high speed mud pulse telemetry is seriously degraded and attenuated due to the operation of the drilling motor. Accordingly, there remains a need in the art for improved bottom hole assemblies (BHAs) for casing drilling systems.

SUMMARY OF THE DISCLOSURE

A casing drilling bottom hole assembly (BHA) may include a modulator and turbine power generation system, a wireless power and data connection, and a rotary steerable system (RSS). The modulator and turbine power generation system is coupled to a casing. The wireless power and data connection is coupled to a downhole end of the high speed modulator and turbine power generation system for providing power and data connectivity between the high speed modulator and turbine power generation system and a drilling motor. The RSS is coupled to the drilling motor for receiving power from and communicating with the high speed modulator and turbine power generation system via the wireless power and data connection and the drilling motor.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass parts having the same reference numeral in figures.

FIG. 19 is an equation for comparatively modeling signal strengths in a casing versus drilling operation;

DETAILED DESCRIPTION

The system described below mentions how power and/or communications may flow from an Measurement While Drilling (MWD) power system through a positive displacement motor to a rotary steerable system ("RSS") and/or Logging While Drilling systems. One of ordinary skill in the art recognizes that communications may easily flow in the other direction—from the RSS and/or LWD equipment to the MWD system.

Figure 1A:
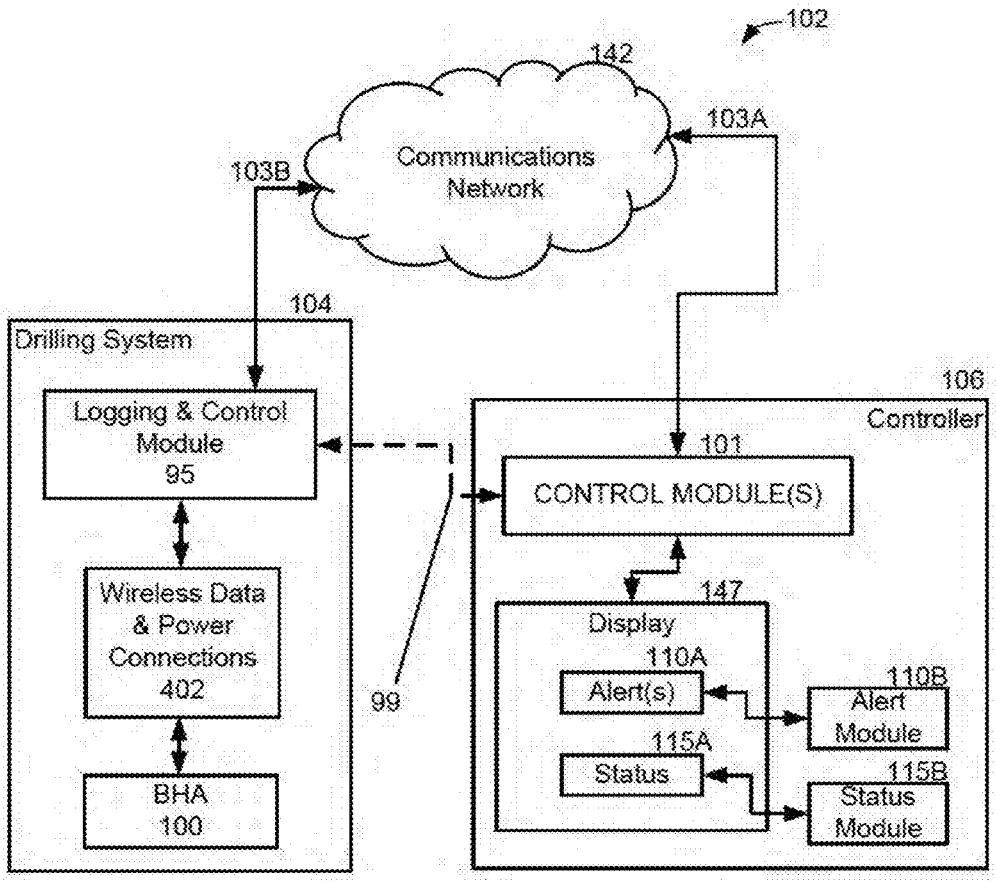
FIG. 1A is a diagram of a system for wireless drilling and mining extenders in a drilling operation.

Referring initially to FIG. 1A, this figure is a diagram of a system 102 for controlling and monitoring a drilling operation. The system 102 includes a control module 101 that is part of a controller 106. The system 102 also includes a drilling system 104, which has a logging and control module 95, a bottom hole assembly ("BHA") 100, and wireless power and data connections 402. The wireless power and data connections 402 may exist between several elements of the BHA 100 as will be explained below.

The controller 106 further includes a display 147 for conveying alerts 110A and status information 115A that are produced by an alerts module 110B and a status module 115B. The controller 106 in some instances may communicate directly with the drilling system 104 as indicated by dashed line 99 or the controller 106 may communicate indirectly with the drilling system 104 using the communications network 142

The controller 106 and the drilling system 104 may be coupled to the communications network 142 via communication links 103. Many of the system elements illustrated in FIG. 1A are coupled via communications links 103 to the communications network 142.

Figure 1B:
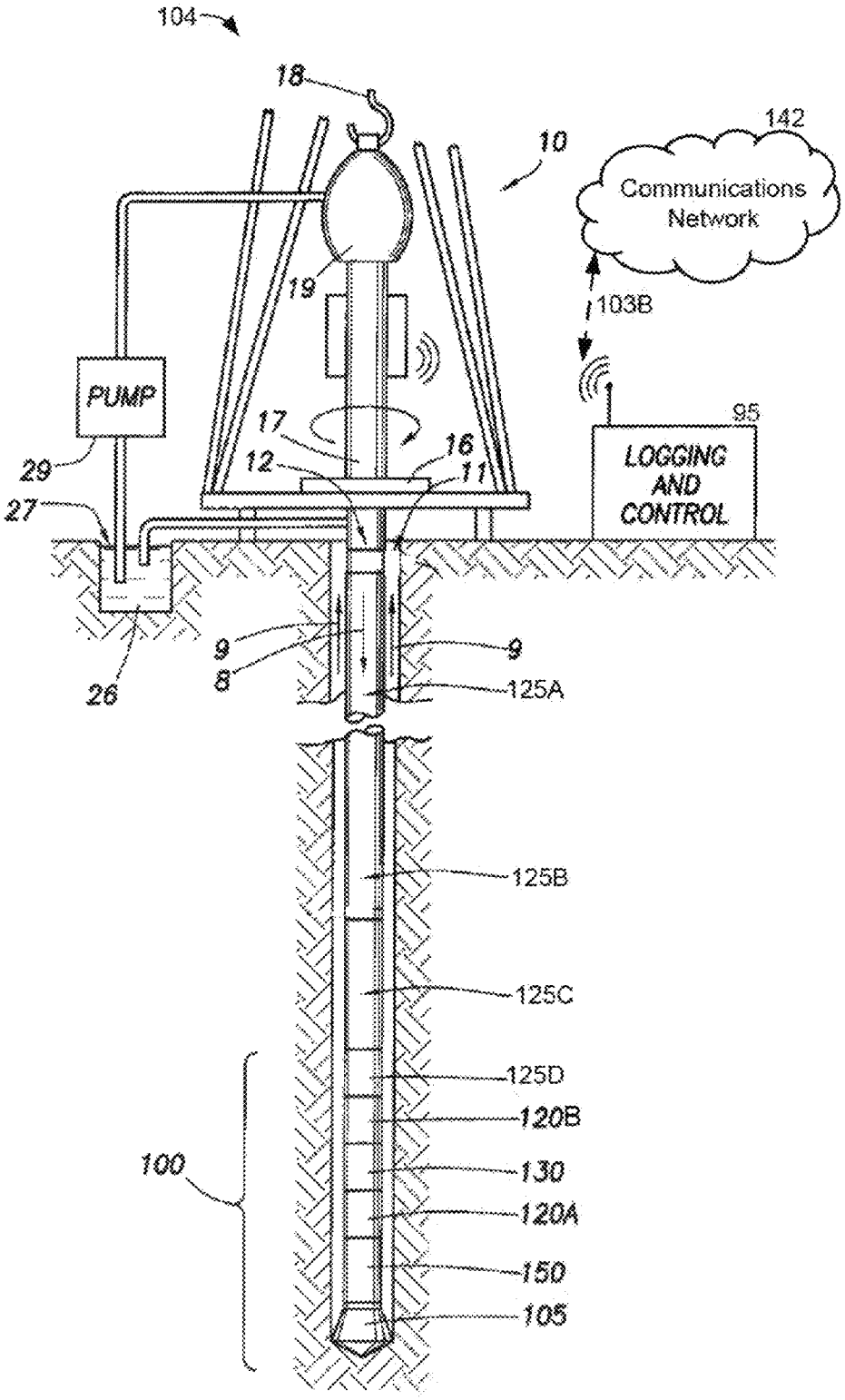
FIG. 1B is a diagram of a wellsite drilling system that forms part of the system illustrated in FIG. 1A.

FIG. 1B illustrates a wellsite drilling system 104 that forms part of the system 102 illustrated in FIG. 1A. The wellsite can be onshore or offshore. In this system 104, a borehole 11 is formed in subsurface formations by rotary drilling in a manner that is known to one of ordinary skill in the art. Embodiments of the system 104 can also use directional drilling, as will be described hereinafter. The drilling system 104 includes the logging and control module 95 as discussed above in connection with FIG. 1A.

A drill string 12 is suspended within the borehole 11 and has a bottom hole assembly ("BHA") 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string 12 relative to the hook 18. As is known to one of ordinary skill in the art, a top drive system could alternatively be used instead of the kelly 17 and rotary table 16 to rotate the drill string 12 from the surface. The drill string 12 may be assembled from a plurality of segments 125 of pipe and/or collars threadedly joined end to end.

In the embodiment of FIG. 1B, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string 12 and the wall of the borehole 11, as indicated by the directional arrows 9. In this system as understood by one of ordinary skill in the art, the drilling fluid 26 lubricates the drill bit 105 and carries formation cuttings up to the surface as it is returned to the pit 27 for cleaning and recirculation.

The BHA 100 of the illustrated embodiment may include a logging-while-drilling ("LWD") module 120, a measuring-while-drilling ("MWD") module 130, a roto-steerable system ("RSS") and motor 150 (also illustrated as 280 in FIG. 15 described below), and drill bit 105.

The LWD module 120 is housed in a special type of drill collar, as is known to one of ordinary skill in the art, and can contain one or a plurality of known types of logging tools. It will also be understood that more than one LWD 120 and/or MWD module 130 can be employed, e.g. as represented at 120A. (References, throughout, to a module at the position of 120A can alternatively mean a module at the position of 120B as well.) The LWD module 120 includes capabilities for measuring, processing, and storing information, as well as for communicating with the surface equipment. In the present embodiment, the LWD module 120 includes a directional resistivity measuring device.

The MWD module 130 is also housed in a special type of drill collar, as is known to one of ordinary skill in the art, and can contain one or more devices for measuring characteristics of the drill string 12 and drill bit 105. The MWD module 130 may further include an apparatus (not shown) for generating electrical power to the BHA 100.

This apparatus may include a mud turbine generator powered by the flow of the drilling fluid 26, it being understood by one of ordinary skill in the art that other power and/or battery systems may be employed. In the embodiment, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

The foregoing examples of wireline and drill string conveyance of a well logging instrument are not to be construed as a limitation on the types of conveyance that may be used for the well logging instrument. Any other conveyance known to one of ordinary skill in the art may be used, including without limitation, slickline (solid wire cable), coiled tubing, well tractor and production tubing.

Figure 1C:
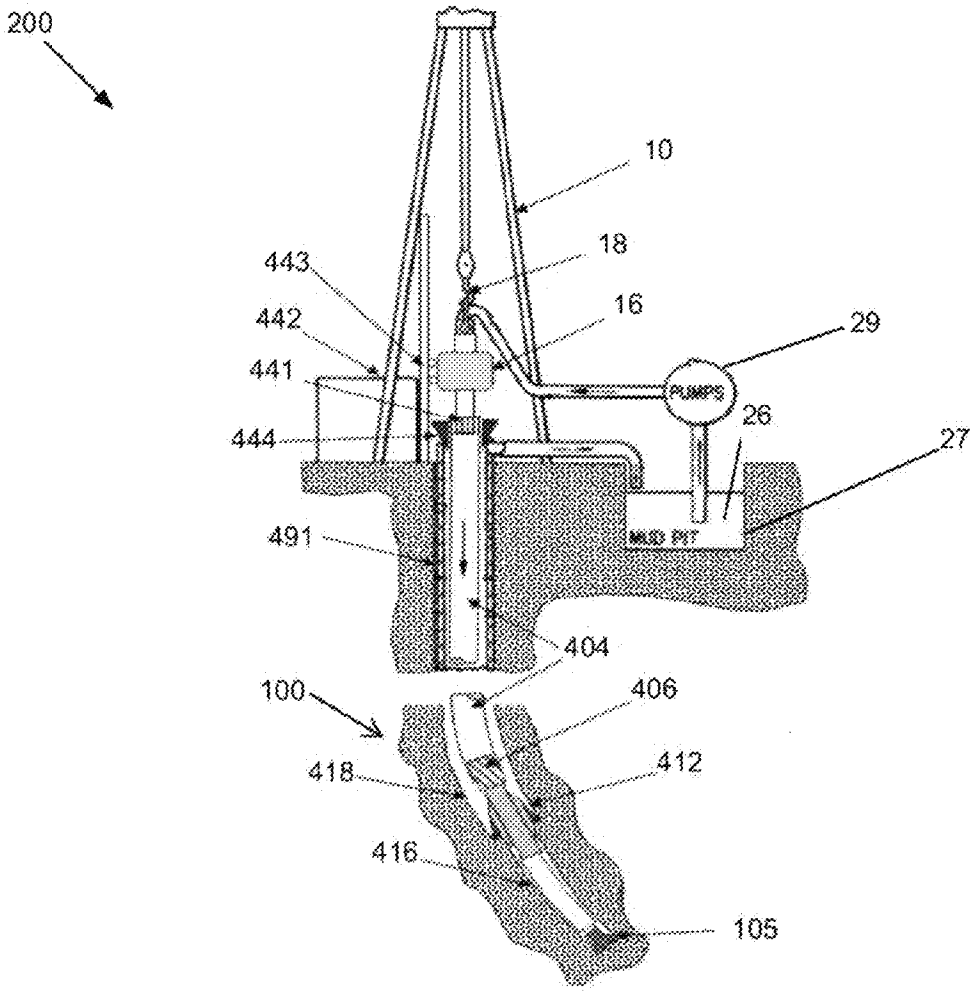
FIG. 1C is a diagram of an embodiment of a casing drilling system that includes a BHA for enabling wireless power and data transfer between components in the BHA.

FIG. 1C illustrates an embodiment of the drilling system 104 that includes a casing drilling system 200. The casing drilling system 200 may have several parts which are similar to those illustrated in the standard drillpipe drilling system 104 as illustrated in FIG. 1B. Therefore, only the differences between the two systems 104, 200 will be described below.

The casing drilling system 200 may include casing 404 that couples with a BHA 100 via a drilling latch assembly ("DLA") 406. The DLA 406 may coupled with an underreamer 412 that is also attached to a drill bit 105. The underreamer 412 may form the reamed hole 418 which has a diameter which is greater than the diameter of the pilot hole 416 for by the drill bit 105.

The casing drilling system 200 may further include conductor pipe 491 which may surround and protect the casing 404 near the Earth's surface. The casing drilling system 200 may further include casing slips 444, a casing drive head/assembly 441, draw works 442, and a guide rail and top drive/block dolly 443 as understood by one of ordinary skill the art. Further details of a modified BHA 100 having wireless power and data connections 402 for the casing drilling system 200 will be described below in connection with FIGS. 15-18.

Figure 2:
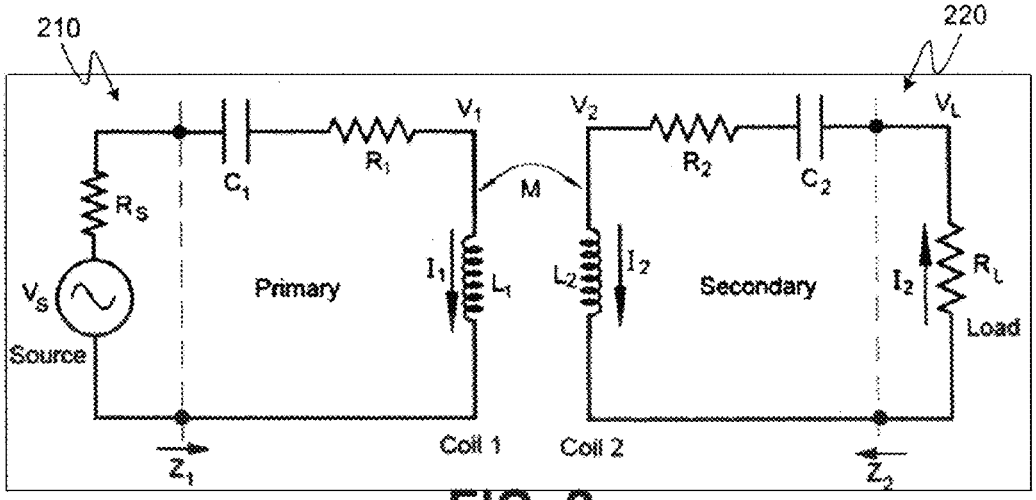
FIG. 2 is a schematic drawing depicting a primary or transmitting circuit and a secondary or receiving circuit.

FIG. 2 is a schematic drawing depicting a primary or transmitting circuit 210 and a secondary or receiving circuit 220. In this description, the time dependence is assumed to be $\exp(j\omega t)$ where $\omega=2\pi f$ and f is the frequency in Hertz. Returning to the FIG. 2 illustration, the transmitting coil is represented as an inductance $L_1$ and the receiving coil as $L_2$. In the primary circuit 210, a voltage generator with constant output voltage $V_S$ and source resistance $R_S$ drives a current $I_1$ through a tuning capacitor $C_1$ and primary coil having self-inductance $L_1$ and series resistance $R_1$. The secondary circuit 220 has self-inductance $L_2$ and series resistance $R_2$. The resistances, $R_1$ and $R_2$, may be due to the coils' wires, to losses in the coils magnetic cores (if present), and to conductive materials or mediums surrounding the coils. The Emf (electromotive force) generated in the receiving coil is $V_2$, which drives current $I_2$ through the load resistance $R_L$ and tuning capacitor $C_2$. The mutual inductance between the two coils is M, and the coupling coefficient k is defined as:

$$k=M/\sqrt{L_1L_2} \tag{1}$$

While a conventional inductive coupler has $k\approx1$, weakly coupled coils may have a value for k less than 1 such as, for example, less than or equal to about 0.9. To compensate for weak coupling, the primary and secondary coils in the various embodiments are resonated at the same frequency. The resonance frequency is calculated as:

$$\omega_0 = \frac{1}{\sqrt{L_1C_1}} = \frac{1}{\sqrt{L_2C_2}} \tag{2}$$

At resonance, the reactance due to $L_1$ is cancelled by the reactance due to $C_1$. Similarly, the reactance due to $L_2$ is cancelled by the reactance due to $C_2$. Efficient power transfer may occur at the resonance frequency, $f_0=\omega_0/2\pi$. In addition, both coils may be associated with high quality factors, defined as:

$$Q_1 = \frac{\omega L_1}{R_1} \text{ and } Q_2 = \frac{\omega L_2}{R_2}. \tag{3}$$

The quality factors, Q, may be greater than or equal to about 10 and in some embodiments greater than or equal to about 100. As is understood by one of ordinary skill in the art, the quality factor of a coil is a dimensionless parameter that characterizes the coil's bandwidth relative to its center frequency and, as such, a higher Q value may thus indicate a lower rate of energy loss as compared to coils with lower Q values.

If the coils are loosely coupled such that $k<1$, then efficient power transfer may be achieved provided the figure of merit, U, is larger than one such as, for example, greater than or equal to about 3:

$$U=k\sqrt{Q_1Q_2}>>1. \tag{4}$$

The primary and secondary circuits are coupled together via:

$$V_1=j\omega L_1I_1+j\omega MI_2 \text{ and } V_2=j\omega L_2I_2+j\omega MI_1, \tag{5}$$

where $V_1$ is the voltage across the transmitting coil. Note that the current is defined as clockwise in the primary circuit and counterclockwise in the secondary circuit. The power delivered to the load resistance is:

$$P_L = \frac{1}{2}R_L|I_2|^2, \tag{6}$$

while the maximum theoretical power output from the fixed voltage source $V_S$ into a load is:

$$P_{MAX} = \frac{|V_S|^2}{8R_S}. \tag{7}$$

The power efficiency is defined as the power delivered to the load divided by the maximum possible power output from the source, $$\eta \equiv \frac{P_L}{P_{MAX}}. \tag{8}$$

In order to optimize the power efficiency, η, the source resistance may be matched to the impedance of the rest of the circuitry. Referring to FIG. 2, $Z_1$ is the impedance looking from the source toward the load and is given by:

$$Z_1 = R_1 - j/(\omega C_1) + j\omega L_1 + \frac{\omega^2 M^2}{R_2 + R_L + j\omega L_2 - j/(\omega C_2)} \quad (9)$$

When $\omega=\omega_0$, $Z_1$ is purely resistive and may equal $R_S$ for maximum efficiency.

$$Z_1 = R_1 + \frac{\omega^2 M^2}{R_2 + R_L} \equiv R_S. \quad (10)$$

Similarly, the impedance seen by the load looking back toward the source is $$Z_2 = R_2 - j/(\omega C_2) + j\omega L_2 + \frac{\omega^2 M^2}{R_1 + R_S + j\omega L_1 - j/(\omega C_1)} \quad (11)$$

When $\omega=\omega_0$, $Z_2$ is purely resistive and $R_L$ should equal $Z_2$ for maximum efficiency $$Z_2 = R_2 + \frac{\omega^2 M^2}{R_1 + R_S} \equiv R_L. \quad (12)$$

The power delivered to the load is then:

$$P_L = \frac{1}{2}\frac{R_L\omega_0^2 M^2 |V_S|^2}{[(R_S + R_1)(R_2 + R_L) + \omega_0^2 M^2]^2}, \quad (13)$$

and the power efficiency is the power delivered to the load divided by the maximum possible power output, $$\eta \equiv \frac{P_L}{P_{MAX}} = \frac{4R_S R_L \omega_0^2 M^2}{[(R_S + R_1)(R_2 + R_L) + \omega_0^2 M^2]^2}. \quad (14)$$

The optimum values for $R_L$ and $R_L$ may be obtained by simultaneously solving $$R_S = R_1 + \frac{\omega^2 M^2}{R_2 + R_L} \text{ and } R_L = R_2 + \frac{\omega^2 M^2}{R_1 + R_S}, \quad (15)$$

with the result that:

$$R_S = R_1\sqrt{1+k^2 Q_1 Q_2} \text{ and } R_L = R_2\sqrt{1+k^2 Q_1 Q_2}. \quad (16)$$

Figure 3:
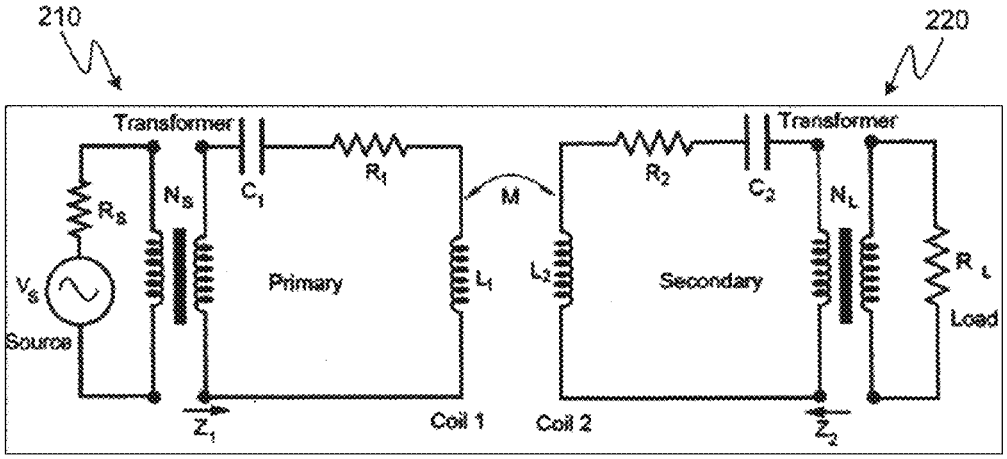
FIG. 3 is a schematic drawing depicting a primary or transmitting circuit and a secondary or receiving circuit with transformers having turn ratios $N_S$:1 and $N_L$:1 that may used to match impedances.
Figure 4:
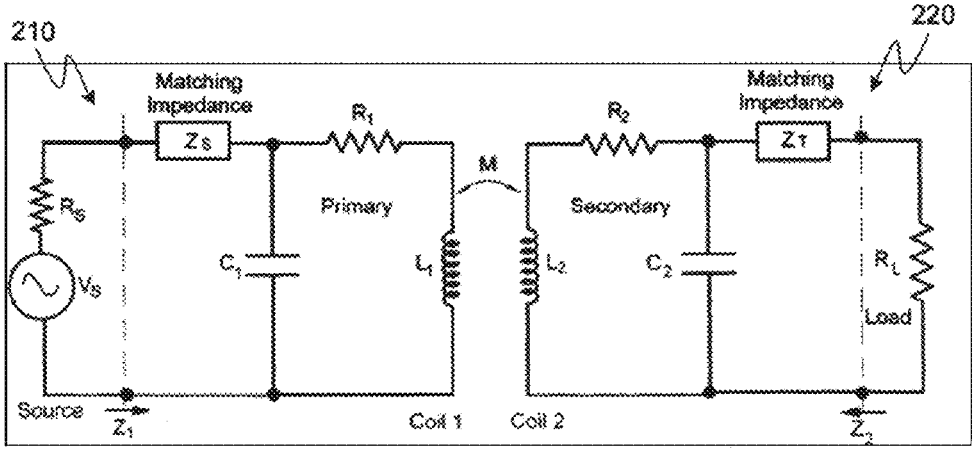
FIG. 4 is a schematic drawing depicting an alternative circuit to that which is depicted in FIG. 3 and having parallel capacitors that are used to resonate the coils' self-inductances.

If the source and load resistances do not satisfy equations (16), then it is envisioned that standard methods may be used to transform the impedances. For example, as shown in the FIG. 3 illustration, transformers with turn ratios $N_S$:1 and $N_L$:1 may be used to match impedances as per equations (16). Alternatively, the circuit illustrated in FIG. 4 may be used. In such an embodiment in FIG. 4, parallel capacitors are used to resonate the coils' self-inductances according to equation (2). As before, $Z_1$ is defined as the impedance seen by the source looking toward the load, while $Z_2$ is defined as the impedance seen by the load looking toward the source. In addition, there are two matching impedances, $Z_S$ and $Z_T$ which may be used to cancel any reactance that would otherwise be seen by the source or load. Hence $Z_1$ and $Z_2$ are purely resistive with the proper choices of $Z_S$ and $Z_T$. Notably, the source resistance $R_S$ may equal $Z_1$, and the load resistance $R_L$ may equal $Z_2$. The procedures for optimizing efficiency with series capacitance or with parallel capacitance may be the same, and both approaches may provide high efficiencies.

Figure 5B:
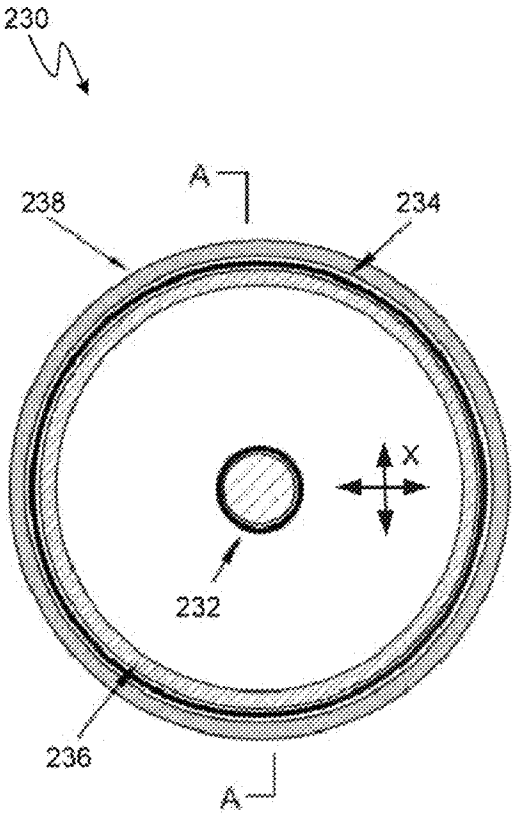
FIGS. 5A-5B illustrate an embodiment of a receiving coil inside a transmitting coil.
Figure 5A:
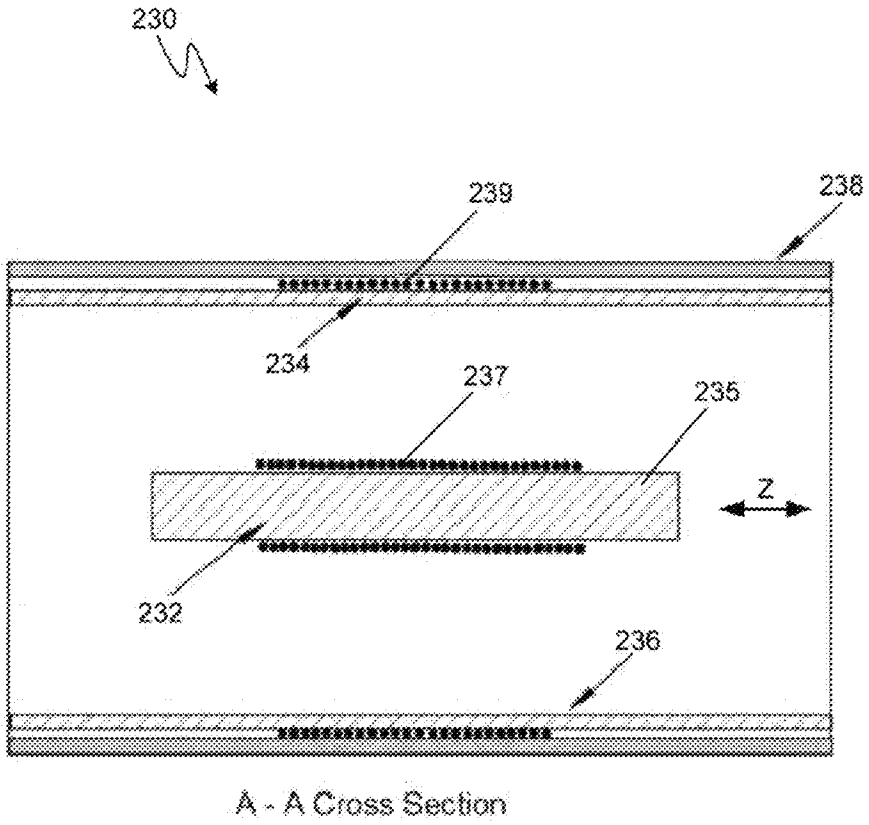

Turning now to FIGS. 5A and 5B, a cross sectional view of two coils 232, 234 is illustrated in FIG. 5A and a side view of the two coils 232, 234 is illustrated in FIG. 5B. In these two figures, a receiving coil 232 inside a transmitting coil 234 of a particular embodiment 230 is depicted. The receiving coil 232 includes a ferrite rod core 235 that, in some embodiments, may be about 12.5 mm (about 0.49 inch) in diameter and about 96 mm (about 3.78 inches) long with about thirty-two turns of wire 237. Notably, although specific dimensions and/or quantities of various components may be offered in this description, it will be understood by one of ordinary skill in the art that the embodiments are not limited to the specific dimensions and/or quantities described herein.

Returning to FIG. 5, the transmitting coil 234 may include an insulating housing 236, about twenty-five turns of wire 239, and an outer shell of ferrite 238. The wall thickness of the ferrite shell 238 in the FIG. 5 embodiment may be about 1.3 mm (about 0.05 inch). In certain embodiments, the overall size of the transmitting coil 234 may be about 90 mm (about 3.54 inch) in diameter by about 150 mm (about 5.90 inches) long. The receiving coil 232 may reside inside the transmitting coil 234, which is annular.

The receiving coil 232 may be free to move in the axial (z) direction or in the transverse direction (x) with respect to the transmitting coil 234. In addition, the receiving coil 232 may be able to rotate on axis with respect to the transmitting coil 234. The region between the two coils 232, 234 may be filled with air, fresh water, salt water, oil, natural gas, drilling fluid (known as "mud"), or any other liquid or gas. The transmitting coil 234 may also be mounted inside a metal tube, with minimal affect on the power efficiency because the magnetic flux may be captured by, and returned through, the ferrite shell 238 of the transmitting coil 234.

The operating frequency for these coils 232, 234 may vary according to the particular embodiment, but, for the FIG. 5 example 230, a resonant frequency f=100 kHz may be assumed. At this frequency, the transmitting coil 234 properties are: $L_1=6.76\cdot10^{-5}$ Henries and $R_1=0.053$ ohms, and the receiving coil 232 properties are $L_2=7.55\cdot10^{-5}$ Henries and $R_2=0.040$ ohms. The tuning capacitors are $C_1=3.75\cdot10^{-8}$ Farads and $C_2=3.36\cdot10^{-8}$ Farads. Notably, the coupling coefficient k value depends on the position of the receiving coil 232 inside the transmitting coil 234. The receiving coil 232 is centered when x=0 and z=0 and there is k=0.64.

Figure 6:
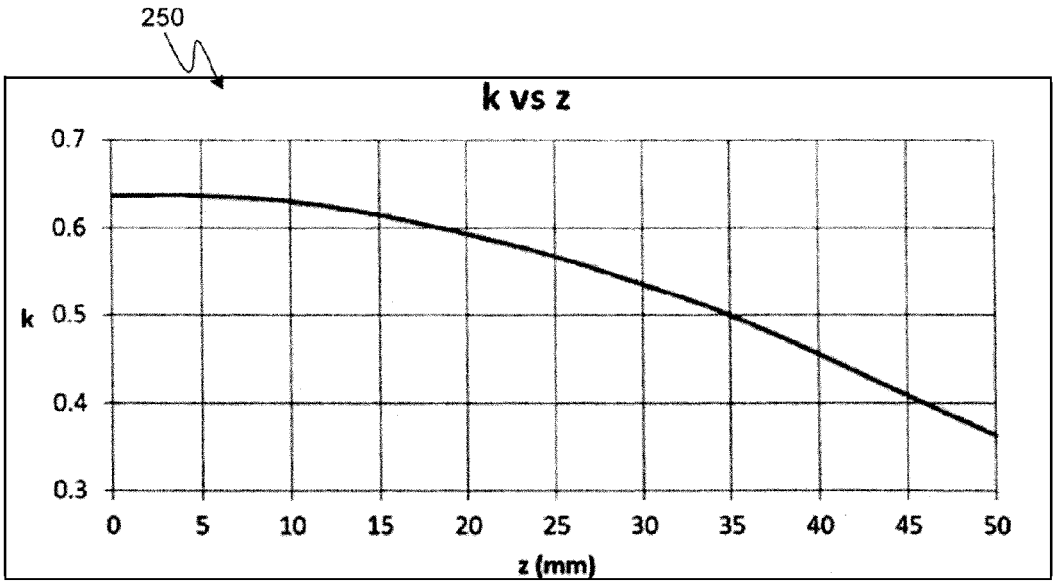
FIGS. 6-7 are graphs illustrating the variation in k versus axial displacement of the receiving coil when x=0 is small and the transverse displacement when z=0 produces very small changes in k of given embodiments, respectively.
Figure 7:
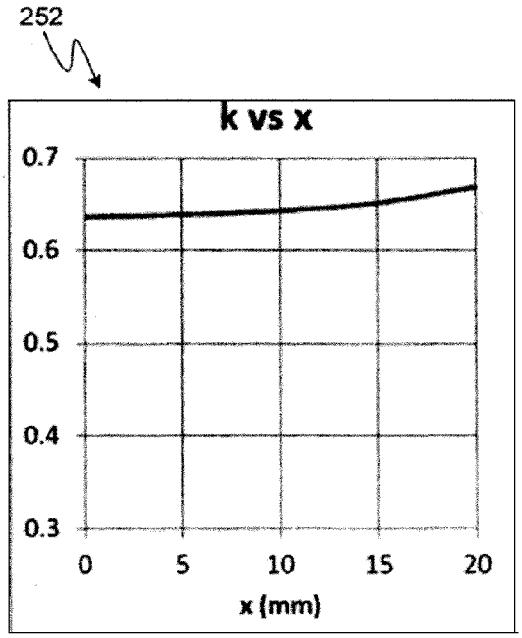

The variation in k versus axial displacement of the receiving coil 232 when x=0 may be relatively small, as illustrated by the graph 250 in FIG. 6. The transverse displacement when z=0 may produce very small changes in k, as illustrated by the graph 252 in FIG. 7. The receiving coil 232 may rotate about the z-axis without affecting k because the coils are azimuthally symmetric. According to equations (16), an optimum value for the source resistance may be $R_S=32$ ohms, and for the load resistance may be $R_L=24$ ohms when the receiving coil 232 is centered at x=0 and z=0. The power efficiency may thus be $\eta=99.5\%$.

Figure 8:
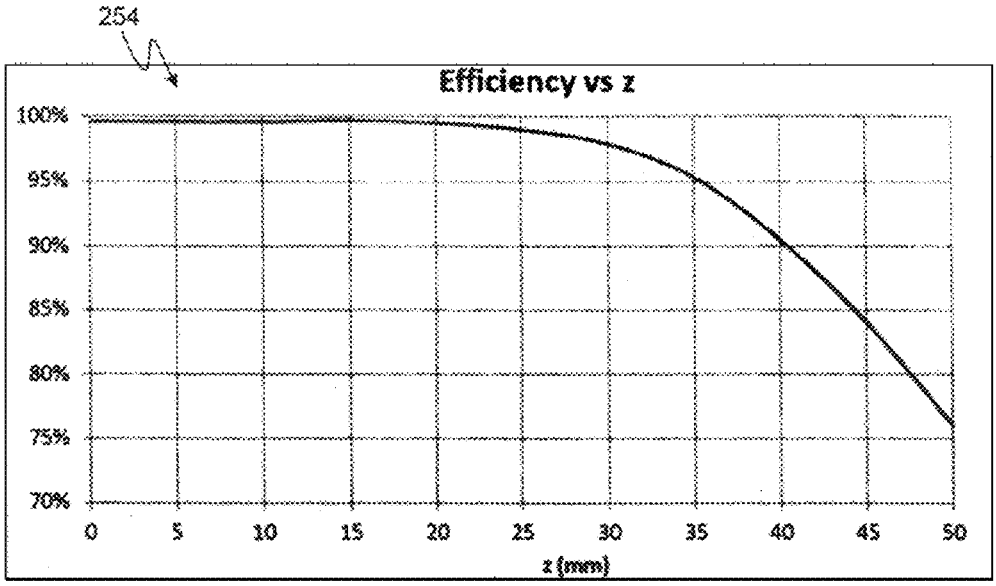
FIGS. 8-9 are graphs illustrating that power efficiency may also be calculated for displacements from the center in the z direction and in the x direction, respectively, of given embodiments.
Figure 9:
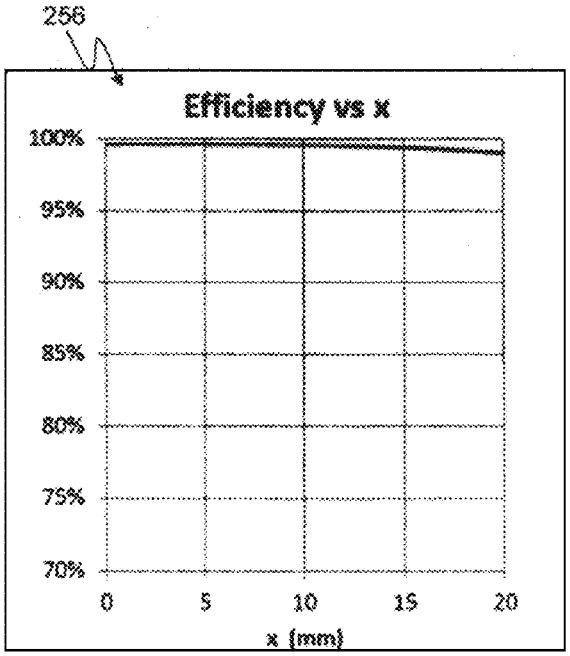

The power efficiency may also be calculated for displacements from the center in the z direction in mm (as illustrated by the graph 254 in FIG. 8) and in the x direction in mm (as illustrated by the graph 256 in FIG. 9). It is envisioned that the efficiency may be greater than about 99% for axial displacements up to about 20.0 mm (about 0.79 inch) in certain embodiments, and greater than about 95% for axial displacements up to about 35.0 mm (about 1.38 inches). It is further envisioned that the efficiency may be greater than 98% for transverse displacements up to 20.0 mm (about 0.79 inch) in some embodiments. Hence, the position of the receiving coil 232 inside the transmitting coil 234 may vary in some embodiments without reducing the ability of the two coils 232, 234 to efficiently transfer power.

Figure 10:
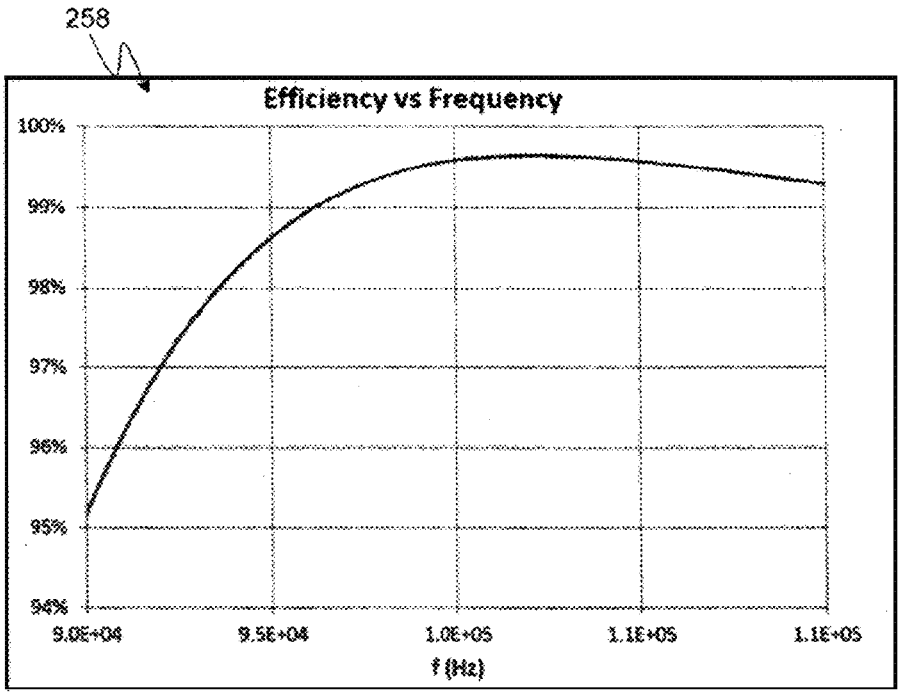
FIG. 10 is a graph illustrating that the sensitivity of the power efficiency to frequency drifts may be relatively small in some embodiments.
Figure 11:
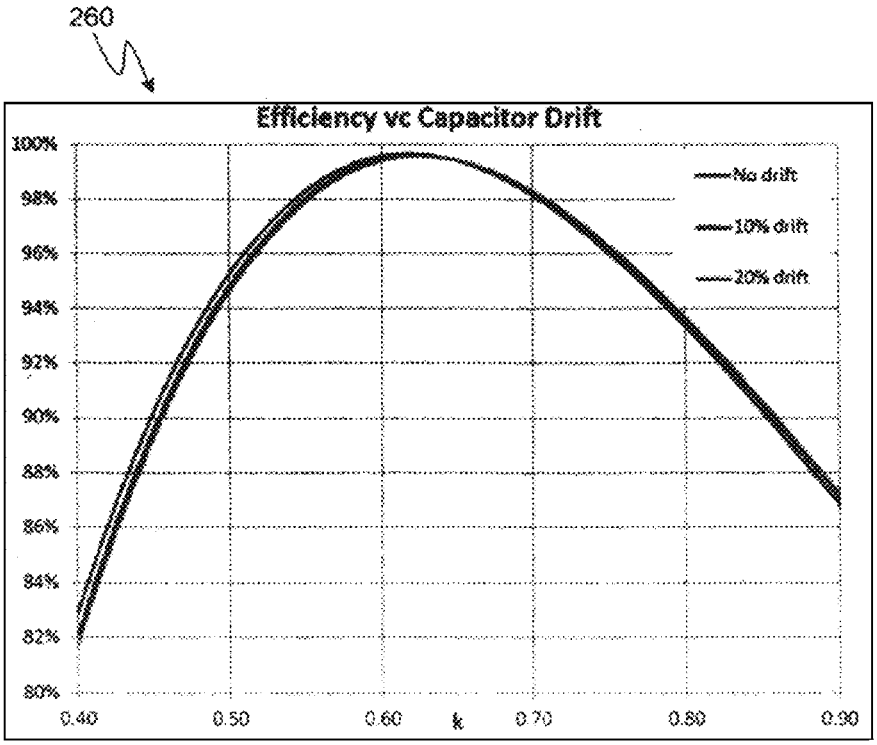
FIG. 11 is a graph illustrating that drifts in the components values of some embodiments do not have a large effect on the power efficiency of the embodiment.

Referring now to FIG. 10, it can be seen in the illustrative graph 258 where the Y-axis denotes efficiency in percentage and the X-axis denotes frequency in Hz that the sensitivity of the power efficiency to frequency drifts may be relatively small. A ±10% variation in frequency may produce minor effects, while the coil parameters may be held fixed. The power efficiency at 90,000 Hz is better than about 95%, and the power efficiency at 110,000 Hz is still greater than about 99%. Similarly, drifts in the component values may not have a large effect on the power efficiency. For example, both tuning capacitors $C_1$ and $C_2$ are allowed to increase by about 10% and by about 20% as illustrated in the graph 260 of FIG. 11. Notably, the other parameters are held fixed, except for the coupling coefficient k. The impact of the power efficiency is negligible. As such, the system described herein would be understood by one of ordinary skill in the art to be robust.

It is also envisioned that power may be transmitted from the inner coil to the outer coil of particular embodiments, interchanging the roles of transmitter and receiver. It is envisioned that the same power efficiency would be realized in both cases.

Figure 12:
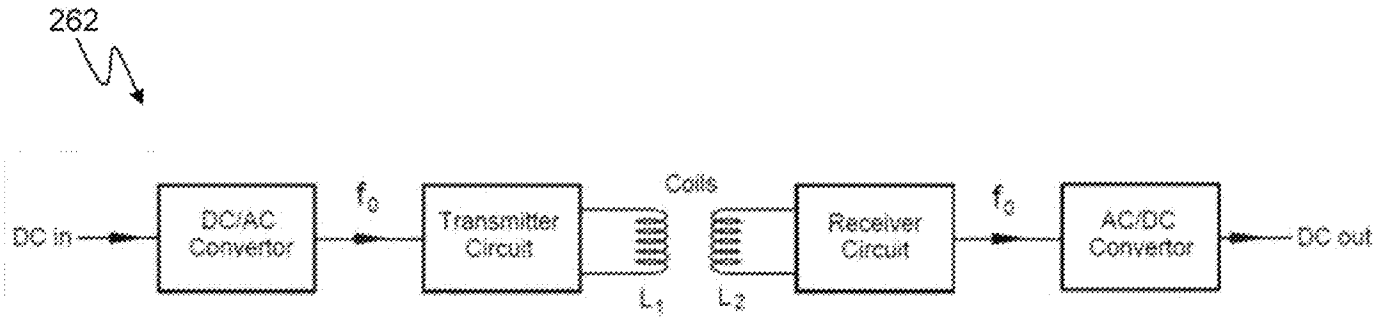
FIG. 12 depicts a particular embodiment configured to convert input DC power to a high frequency AC signal, $f_0$, via a DC/AC convertor.

Referring to FIG. 12, an electronic configuration 262 is illustrated for converting input DC power to a high frequency AC signal, $f_0$, via a DC/AC convertor. The transmitter circuit in the configuration 262 excites the transmitting coil at resonant frequency $f_0$. The receiving circuit drives an AC/DC convertor, which provides DC power output for subsequent electronics. This system 262 is appropriate for efficient passing DC power across the coils.

Figure 13:
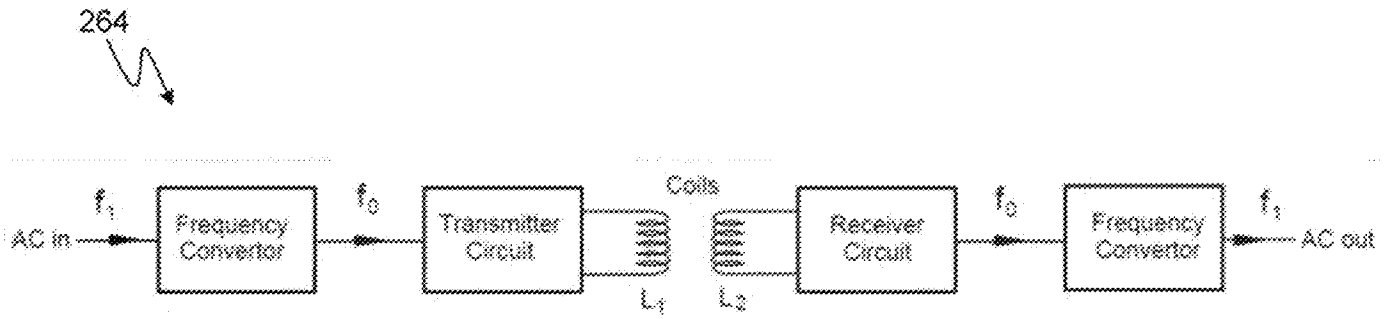
FIG. 13 depicts a particular embodiment configured to pass AC power through the coils.

Turning to FIG. 13, AC power can be passed through the coils. Input AC power at frequency $f_1$ is converted to resonant frequency $f_0$ by a frequency convertor. Normally this would be a step up convertor with $f_0 >> f_1$. The receiver circuit outputs power at frequency $f_0$, which is converted back to AC power at frequency $f_1$. Alternatively, as one of ordinary skill in the art recognizes, the FIG. 13 embodiment 264 could be modified to accept DC power in and produce AC power out, and vice versa.

In lieu of, or in addition to, passing power, data signals may be transferred from one coil to the other in certain embodiments by a variety of means. In the above example, power is transferred using an about 100.0 kHz oscillating magnetic field. It is envisioned that this oscillating signal may also be used as a carrier frequency with amplitude modulation, phase modulation, or frequency modulation used to transfer data from the transmitting coil to the receiving coil. Such would provide a one-way data transfer.

An alternative embodiment includes additional secondary coils to transmit and receive data in parallel with any power transmissions occurring between the other coils described above, as illustrated in FIG. 14. Such an arrangement may provide two-way data communication in some embodiments. The secondary data coils 266, 268 may be associated with relatively low power efficiencies of less than about 10%. It is envisioned that in some embodiments the data transfer may be accomplished with a good signal to noise ratio, for example, about 6.0 dB or better. The secondary data coils 266, 268 may have fewer turns than the power transmitting 234 and receiving coils 232.

Figure 14:
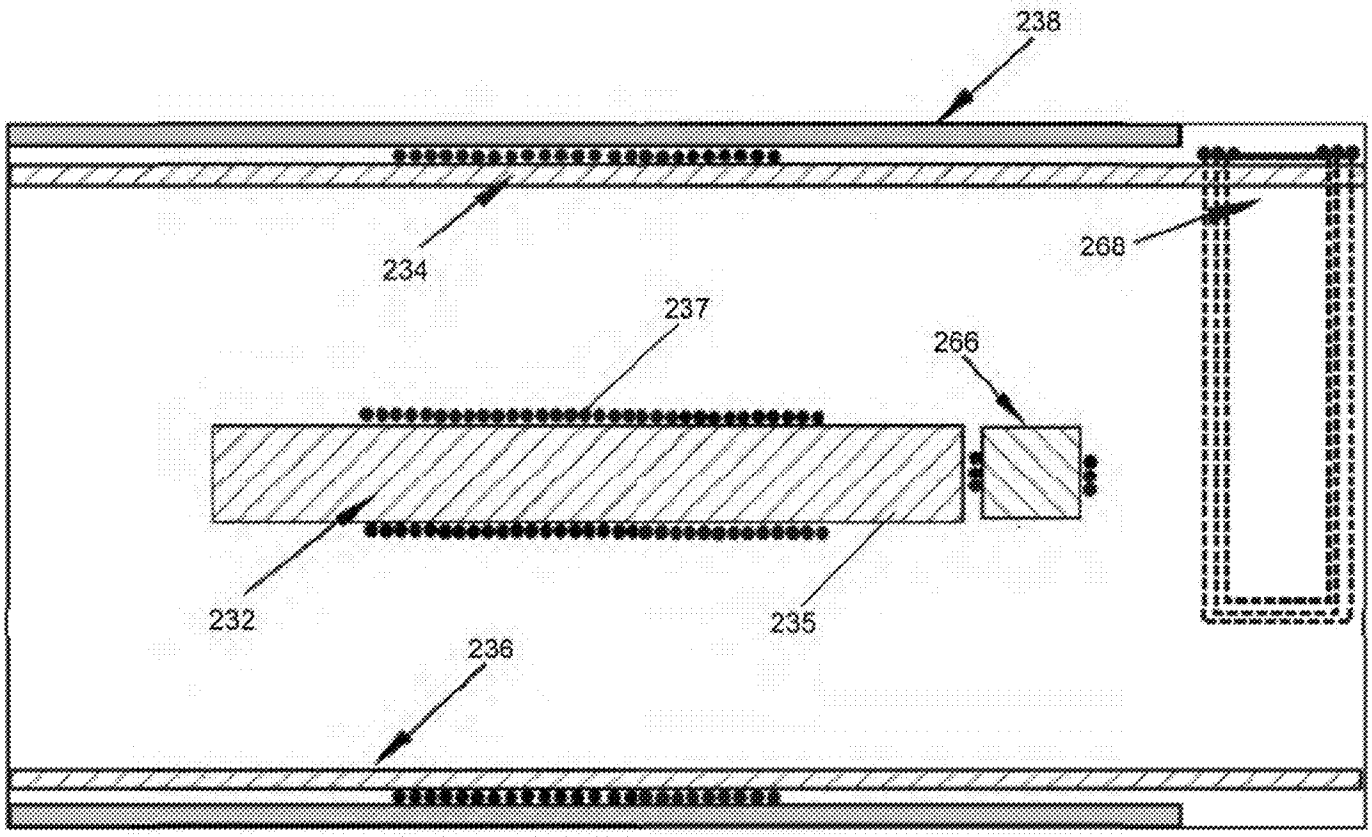
FIG. 14 depicts a particular embodiment that includes additional secondary coils configured to transmit and receive data.

The secondary data coils 266, 268 may be orthogonal to the power coils 232, 234, as illustrated in FIG. 14. For example, the magnetic flux from the power transmitting coils 232, 234 may be orthogonal to a first data coil 266, so that it does not induce a signal in the first data coil 266. A second data coil 268 may be wrapped as shown in FIG. 14 such that magnetic flux from the power transmitters does not pass through it, but magnetic flux from first data coil 266 does. Notably, the configuration depicted in FIG. 14 is offered for illustrative purposes only and is not meant to suggest that it is the only configuration that may reduce or eliminate the possibility that a signal will be induced in one or more of the data coils by the magnetic flux of the power transmitting coils. Other data coil configurations that may minimize the magnetic flux from the power transmitter exciting the data coils will occur to those with ordinary skill in the art.

Moreover, it is envisioned that the data coils 266, 268 may be wound on a non-magnetic dielectric material in some embodiments. Using a magnetic core for the data coils 266, 268 might result in the data coils' cores being saturated by the strong magnetic fields used for power transmission. Also, the data coils 266, 268 may be configured to operate at a substantially different frequency than the power transmission frequency. For example, if the power is transmitted at about 100.0 kHz in a certain embodiment, then the data may be transmitted at a frequency of about 1.0 MHz or higher. In such an embodiment, high pass filters on the data coils 266, 268 may prevent the about 100.0 kHz signal from corrupting the data signal. In still other embodiments, the data coils 266, 268 may simply be located away from the power coils 232, 234 to minimize any interference from the power transmission. It is further envisioned that some embodiments may use any combination of these methods to mitigate or eliminate adverse effects on the data coils 266, 268 from the power transmission of the power coils 232, 234.

Figure 15:
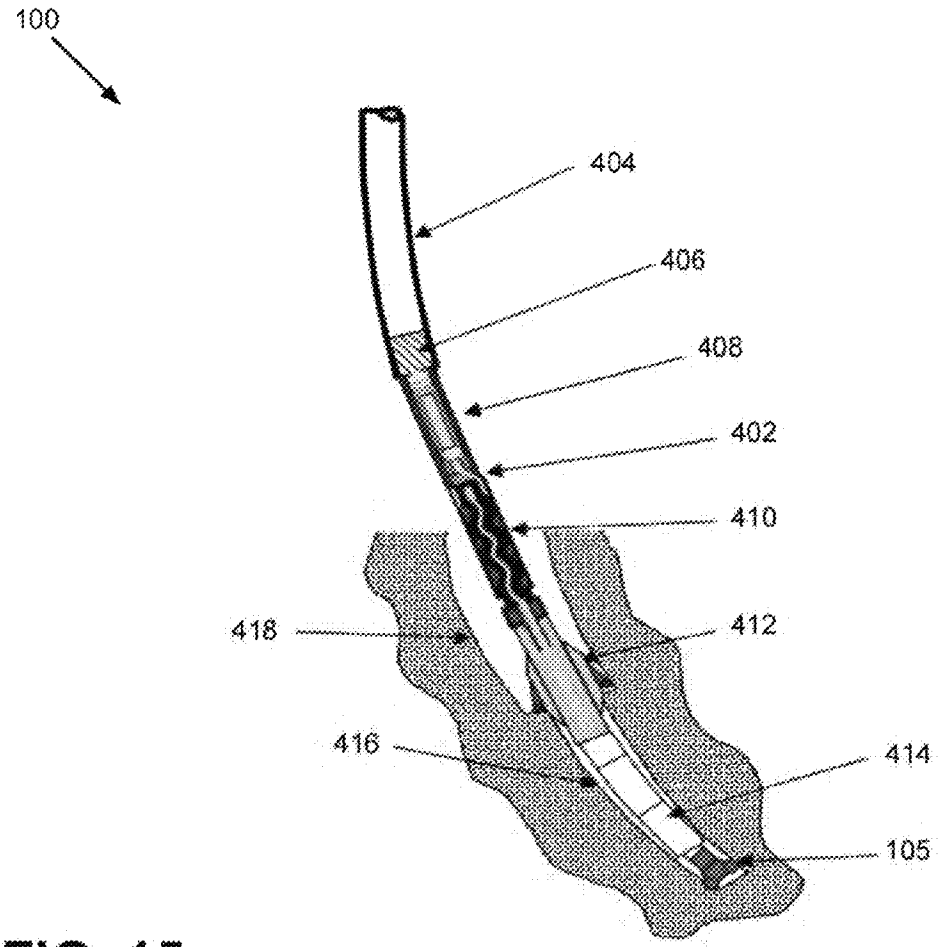
FIG. 15 is a diagram illustrating an embodiment of a casing drilling BHA that includes a wireless power and data connection for enabling wireless power and data transfer between components in the BHA.

FIG. 15 illustrates an embodiment of a casing drilling BHA 100 for providing wireless power and data connectivity/communications 402 between components. It should be appreciated that various BHA components may be used and various configurations may be implemented for arranging the BHA components. These and other configurations may provide wireless power and data transfer to components above and/or below a downhole drilling motor 410 and, thereby, advantageously enable real-time measurement and control of various drilling conditions for optimizing drilling performance and/or reducing drilling costs.

The BHA 100 includes drilling latch assembly ("DLA") 406 for coupling the BHA 100 to a casing 404. The BHA 100 further includes a casing drilling modulator and turbine power system 408, a wireless power and data connection 402, a drilling motor 410, an under-reamer 412, an RSS/MWD/LWD assembly 414 (see also LWD 120 and MWD 130 of FIG. 1B), and a drill bit 105. The under-reamer 412 enlarges the borehole to form the reamed hole 418 relative to the pilot hole 416 formed by the drill assembly 105. Specifically, the under-reamer 412 enlarges the borehole to form the reamed hole 418 such that it has a second diameter which is larger than the pilot hole 416 having a first diameter formed by the drill bit 105.

The casing drilling modulator and turbine power system 408 is located below the drilling latch assembly ("DLA") 406 with a downhole end connected to the drilling motor 410. As understood by one of ordinary skill the art, the DLA 406 allows the turbine power system 408 and remaining equipment downward through the drill bit 105 to be retrieved and withdrawn through the casing 404 when the appropriate depth has been reached. Specifically, the diameter of the drill bit 105 is smaller than the inner diameter of the casing 404. In this way, the casing 404 generally remains in place after drilling operations have ceased such that equipment from the turbine power system 408 may be retrieved upward and through the casing 404. The DLA 406 also forms a fluid tight seal between the turbine power system 408 and the casing 404 so that fluid, such as mud, does not leak between the casing 404 in the turbine power system 408.

Power and data pass through the wireless power and data connection 402 between the modulator and turbine power system 408 and the drilling motor 410. The under-reamer 412, the RSS/MWD/LWD assembly 414, and the drill assembly 105 may be located below the drilling motor 410. As understood by one of ordinary skill in the art, positioning units requiring power and/or communications below a drilling motor 410 has not been possible previously because of the need for power generation with these units, such as the MWD module 130 and LWD module 120.

The under-reamer 412 may include a wired, collapsible under-reamer. The RSS/MWD/LWD assembly 414 generally includes a rotary steerable system (RSS) 150, the MWD module 130, and the LWD module 120. The wireless power and data connection 402 may include a wireless, tuned-inductive coupler mechanism for passing both power and data communications to downhole components of the BHA 100. It should be appreciated that separate coils may be used for power and communication transmissions. The wireless power and data connection 402 may allow the RSS module 414 to receive power from the turbine power system 408. Meanwhile, in conventional BHA assemblies, RSS modules 414 may have their own internal power source. The RSS modules 414 of the BHA 100 of this disclosure may have their own power source but also have the option of being powered by the turbine power system 408 through the wireless power and data connection 402.

The wireless power and data connection 402 allows relative motion between the modulator and turbine power system 408 (which is coupled to an external housing of the drilling motor 410) and a rotor of the drilling motor 410 (which is wired and coupled to the under-reamer 412, the RSS/MWD/LWD assembly 414, and the drill bit assembly 105), allowing power and data transfer throughout the entire BHA 100.

Figure 16:
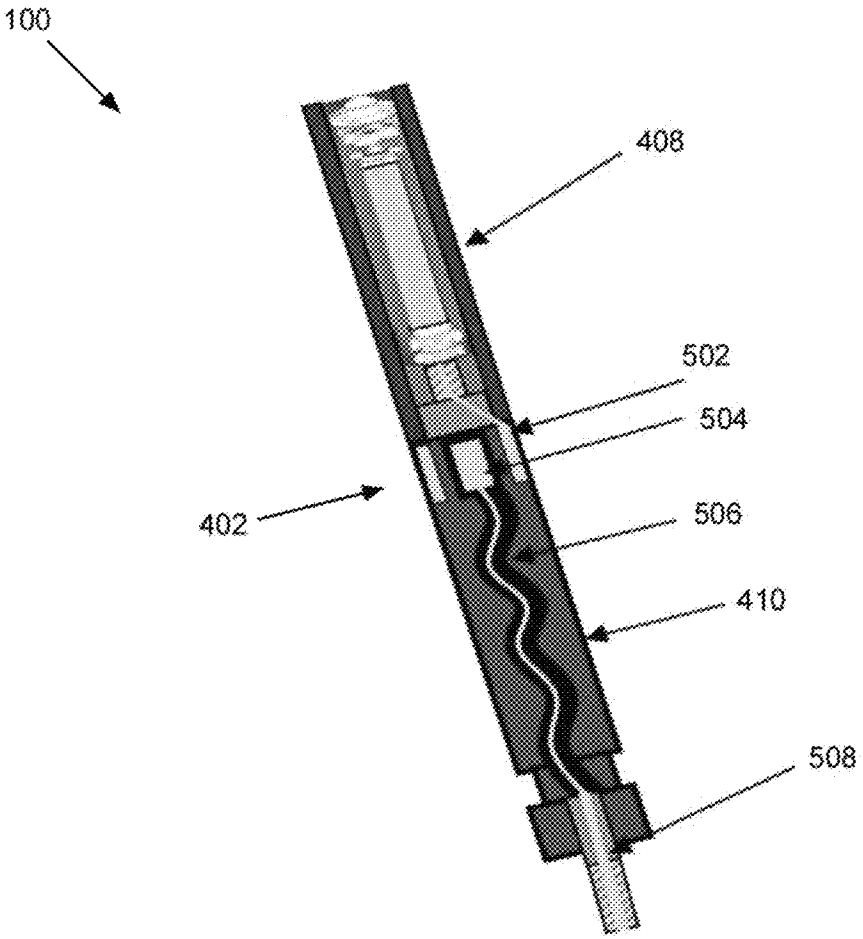
FIG. 16 is a diagram illustrating a more detailed view of the wireless power and data connection in FIG. 15.

FIG. 16 illustrates in more detail the modulator and turbine power system 408 and the drilling motor 410 with the wireless power and data connection 402 in between. The drilling motor 410 is also known as a mud motor or a positive displacement motor as understood by one of ordinary skill in the art.

Power and data wiring exits the downhole end of the modulator and turbine power system 408 and is coupled to a stationary coil 502 of the wireless power and data connection 402 located in the drilling motor 410 external housing. Power and data is transmitted between the stationary coil 502 and a rotating coil 504 via tuned-inductive methods, as described above and illustrated in FIGS. 2-14. Wiring is coupled to the rotating coil 504 and passes through an interior sealed channel in the center of a wired rotor 506 of the drilling motor 410. The modulator and turbine power system 408 are coupled to the casing 404 illustrated in FIG. 15. And the stationary coil 502 is coupled to the modulator and turbine power system 408.

The power system 408 and stationary coil 502 track whatever movement may exist with the casing 404. In some instances, the casing 404 may have some slight rotation at low revolutions per minute ("RPM") relative to the borehole and therefore, the stationary coil 502 may follow this rotational movement of the casing 404. Meanwhile, the rotating coil 404 rotates with the drilling motor 410, and specifically the wired rotor 506, which rotates at significantly higher RPMs in order to rotate the drill assembly 105 as understood by one of ordinary skill in the art.

At the bottom of the rotor 506, the wire is terminated at a connection 508 to the rotating BHA. The connection may include a threaded rotary shouldered joint and a sealed electrical connector mechanically and electrically coupling the rotating mechanism of the drilling motor 410 to the downhole components of the rotating BHA 100 (e.g., under-reamer 412, RSS 150, LWD module 120, MWD module 130, drill bit 105).

Figure 17:
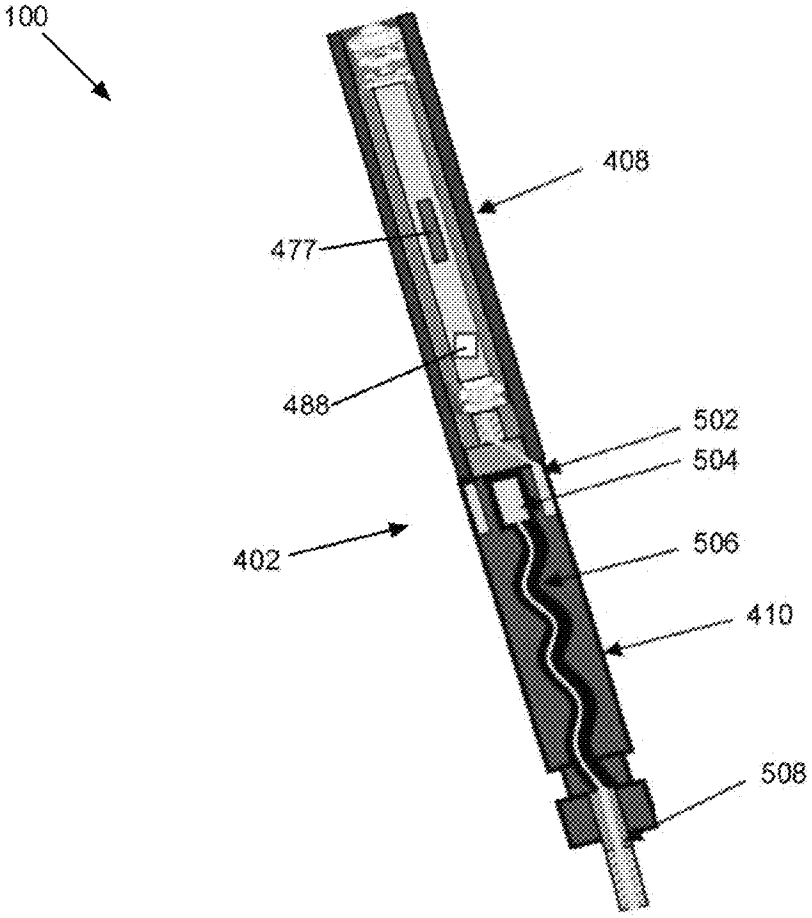
FIG. 17 is a diagram illustrating another embodiment of casing drilling BHA.

FIG. 17 illustrates another embodiment of the BHA 100 in which the MWD module is integrated with the modulator and turbine power system 408. In this embodiment, the MWD module may include a direction & inclination (D&I) sensor package 477. One of ordinary skill in the art will appreciate that this configuration may provide several desirable benefits. For example, when a D&I sensor package 477 is located below the drilling motor 410 (rather than above, as illustrated in FIG. 17), the pumps 29 must be disabled to prevent rotation of the D&I sensor package 477.

Furthermore, turbine power is not available when pumps are off, so a battery would be used to power the D&I sensor package 477 along with logic using other parts of the system to detect when pumps are turned off. The embodiment illustrated in FIG. 17 may eliminate the need for battery power in an MWD module 130 (since the D&I sensor package may be powered by the modulator and turbine power system 408) and it also may reduce the need for stationary surveys of the borehole with pumps 29 turned off.

The power system 408 may also include a battery 488 that utilizes the wireless power and data connection 402. The battery 488 may be used in conjunction with a modulator and turbine power system. Alternatively, the battery 488 may include the sole or primary power source for the power system 408.

Figure 18:
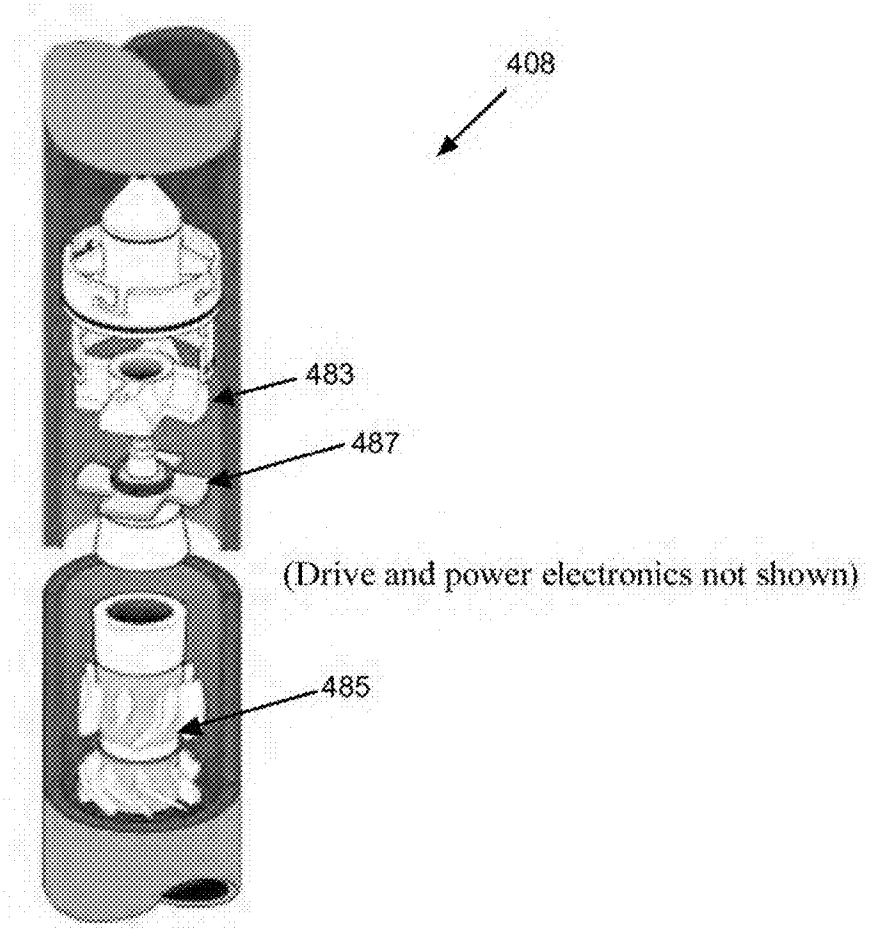
FIG. 18 is a diagram illustrating an embodiment of the modulator and turbine power system of FIG. 15 that includes a rotary pressure pulse generator or modulator.

In an embodiment, as illustrated in FIG. 18, the modulator and turbine power system 408 may include a high-speed rotary "siren" pressure-pulse generator. It should be appreciated that the rotary modulator and turbine power system 408 may be capable of high speed operation, which can generate high frequencies and data rates. Unlike conventional "poppet" type or reciprocating pulsers, the use of the rotary modulator 408 is not inherently limited in speed of operation due to limits of acceleration/deceleration and motion reversal with associated problems of wear, flow-erosion, fatigue, power limitations, etc.

The power and telemetry system 408 may include a stator 483, a rotor 487, and a turbine 485. Stator 483 and rotor 487 are the modulator for producing the telemetry. Stator 483 is static (non-moving) while rotor 487 rotates to create modulation for the telemetry using mudflow.

Mudflow through the power system 408 rotates these elements in order to produce power and the telemetry signals. As noted previously, the power system 408 may include a battery 488 which could be used as a substitute for the turbine 485. Alternate combinations of power generation (i.e. mechanical or electrical/chemical, etc.) for the power system 408 are included within the scope of this disclosure as understood by one of ordinary skill the art. This power and telemetry system 408 may generate negative mud pulse signals as well as positive mud pulse signals. EM telemetry pulse signals from coils (using the data coils 266, 268 of FIG. 14 if the main power coils 237 and 234 cannot pass data) may be produced for internal communications within the BHA as understood by one of ordinary skill the art. As noted above, the D&I sensor package 477 may be powered by the turbine 485 of the modulator and power system 408.

Figure 20:
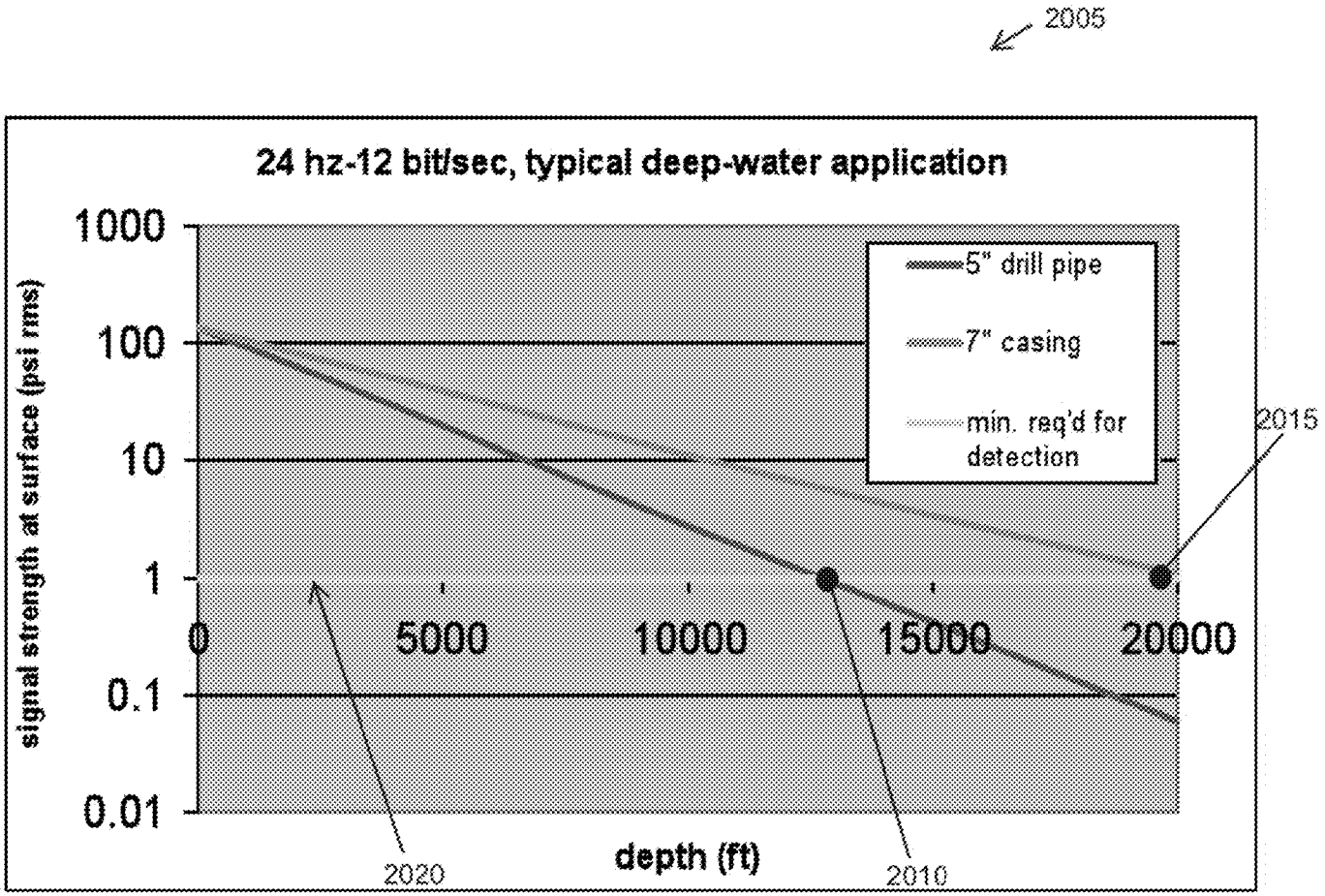
FIG. 20 shows an embodiment of a graphical output of the signal strength model of FIG. 19.
Figure 21:
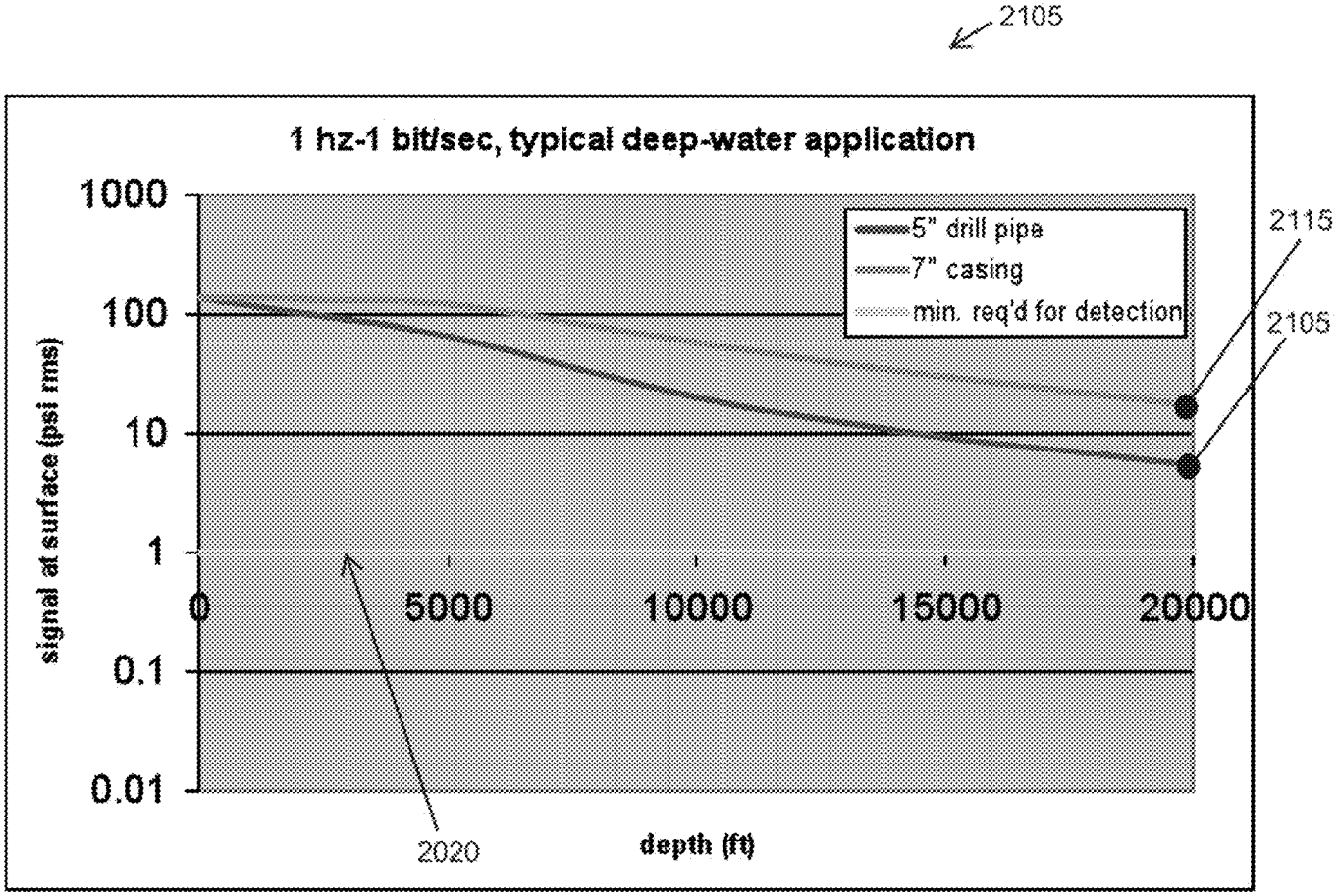
FIG. 21 shows another embodiment of a graphical output of the signal strength model of FIG. 19.

Referring now to FIGS. 19-21, it should be further appreciated that the speed/bandwidth advantages of the rotary modulator and power system 408 and the low rate of attenuation due to the large diameter of the acoustic conduit of casing 404 may result in, for example, approximately a one order of magnitude increase in data rate, when using mud pulse signaling telemetry, as compared to conventional drill pipe conveyed operations when the rotary modulator and power system 408 is located above the drilling motor 410 so high speed telemetry is not degraded. The rotary modulator and power system 408 located above the downhole drilling motor 410 provides for the transmission of large amounts of data for casing drilling.

The equation illustrated in table 1900 of FIG. 19 shows the general effect of various parameters of the mud pulse signal strength and the rate of attenuation in the BHA 100 for casing drilling. In casing drilling applications, the effect of the larger inside diameter (d) within the casing 404 relative to conventional drill pipe BHAs 100 makes higher carrier frequencies (and hence data rate) possible since the rate of attenuation is much less for casing drilling as compared to a conventional drill pipe.

This lower rate of attenuation with the intrinsically high data rate of a rotary mud pulse telemetry system, enable greater bandwidth of real-time data than has been possible with existing directional practice and drill-pipe conveyed MWD systems. The viscosity and bulk modulus of the mud are strongly dependent on type of mud, temperature and pressure and will therefore be functions of total depth, vertical depth, water depth, geographical area, etc.

The equation in graph 1900 of FIG. 19 also demonstrates that more accurate MWD measurements may be made when the D&I sensor package 477 is incorporated in the modulator and turbine power system 408 above the motor 410 as illustrated in FIG. 17. As noted previously, mudflow and mud pulse signaling may be continued even while the D&I sensor package 477 is operating since the sensor package 477 is above the drilling motor 410 and is therefore not rotating with the drill assembly 105. The D&I sensor package 477 may be powered by the turbine 485 of the modulator and power system 408 as described above, so a battery or another external powering system outside of the turbine power system 408 to power the D&I sensor package 477 is not required.

The positive impact of the larger diameter (such as 7.0 inch or 17.8 cm diameter) in casing drilling compared to standard drill pipe drilling (such as 5.0 inch or 12.7 cm diameter) is very apparent in the graph 2005 illustrated in FIG. 20. Graph 2005 is derived from signal strength modeling and prediction software, which takes all of mud pulse signaling parameters into account for a typical deepwater application using synthetic oil based mud.

Graph 2005 shows that with a larger internal diameter of casing (see line with point 2015), telemetry rates in the range of about 12 bit/sec may be possible to depths of approximately 20,000.0 feet or 6.01 km (point 2015) as compared to a smaller drill pipe diameter of about 5.0 inches or 12.7 cm (see line with point 2010) where about a 12 bit/sec data rate is limited to approximately 13,000 feet or 3.96 km. Line 2020 defines a minimum threshold of about 1.0 psi for detecting a signal using mud pulse signaling/modulation.

Further benefits and advantages of the BHA 100 are shown with reference to graph 2105 of FIG. 21. This modeling comparison shows that telemetry with mud pulse signaling using drill pipe having a diameter of about 5.0 inches or 12.7 cm may be limited to approximately 1 bit/sec data rates (see line with point 2110). Hence, there may be a one order of magnitude higher data rate possible under these conditions with casing drilling having a diameter of about 7.0 inches or 17.8 cm (see line with point 2115) compared to the drill pipe scenario (see point 2110).

There may also be an approximately four-fold increase in signal amplitude with casing drilling as compared to standard drill-pipe drilling for about a 1 Hz telemetry in mud pulse signaling. Based on the data in graph 2105, the maximum depth at which a signal may still be detected using casing drilling with 1 Hz telemetry may fall within the range of between about 40,000 to about 50,000 feet (about 12.19 km to about 15.24 km).

It should be appreciated that the above-described configurations for the casing drilling BHA 100 may be integrated with accompanying computer programs for configuring, operating, or otherwise interacting with the real-time measurement and control functionalities enabled by the corresponding BHA configurations. The computer programs may be implemented in control module(s) 101 and/or alert module(s) 110, which include logic for instructing CPU(s) in the controller 106 to execute corresponding methods.

With the system described above, power and/or communications may be efficiently passed from a tool located above the mud motor to the rotor via two coils. One coil may be annular and located in the ID of the drill collar. The other coil is attached to the rotor and is located within the first coil. The coils are high Q and resonated at the same frequency. The impedance of the power source is matched to the impedance looking toward the transmitting coil. The impedance of the load is matched to the impedance looking back toward the source.

Advantages of the inventive method and system include, but are not limited to, the second coil of the two coils being able to rotate and to move in the axial and radial directions without loss of efficiency. According to the inventive method and system, room exists for mud to flow through the two coils. Further, power may be transmitted from the tool above the motor to the bit by passing the wires through the rotor.

Various sensors of the inventive system and method may be located at the bit, powered by the tool located above the mud motor. Measurements at the bit may include, but are not limited to, resistivity, gamma-ray, borehole pressure, bit RPM, temperature, shock, vibration, weight on bit, or torque on bit.

Another advantage of the inventive method and system is that two way communications may be made through the mud motor by adding a second set of coils. Additionally, resistivity measurements at the bit may be made by using two coils as receivers, as powered by this inventive system and method.

The inventive method and system may provide for efficient power transfer. According to one aspect, power may be transmitted between two coils where the two coils do not have to be in close proximity (see equation 1 discussed above) in which k may be less than (<1) or equal to one. Another potential distinguishing aspect of the inventive method and system includes resonating the power transmitting coil with a high quality factor (see equation 3 discussed above) in which Q may be greater than (>) or equal to about 10. Another distinguishing aspect of the system and method may include resonating the power transmitting coil with series capacitance (see equation 2 listed above).

Other unique aspects of the inventive method and system may include resonating the power transmitting coil with parallel capacitance and resonating the power receiving coil with a high quality factor Q (see equation 3) in which Q is greater than (>) or equal to 10. Other unique features of the inventive method and system may include resonating the power receiving coil with series capacitance (see equation 2 discussed above) as well as resonating the power receiving coil with parallel capacitance.

Another unique feature of the inventive method and system may include resonating the transmitting coil and the receiving coil at similar frequencies (see equation 2 described above) as well as matching the impedance of the power supply to the impedance looking toward the transmitting coil (see equation 10 described above). Another distinguishing feature of the inventive method and system may include matching the impedance of the load to the impedance looking back toward the receiving coil (see equation 12 described above).

An additional distinguishing aspect of the inventive method and system may include using magnetic material to increase the coupling efficiency between the transmitting and the receiving coils. Further, the inventive method and system may include a power receiving coil that includes wire wrapped around a ferrite core (for example, see FIG. 14). Meanwhile, the power transmitting coil may include a wire located inside a ferrite core (see FIG. 14). According to another aspect, the power receiving coil may be located inside the power transmitting coil (see FIG. 14).

Although a few embodiments have been described in detail above, those skilled in the art will readily appreciate that many modifications are possible in the embodiments without materially departing from this disclosure. Accordingly, such modifications are intended to be included within the scope of this disclosure as defined in the following claims. In the above discussion of the casing drilling BHA 100, both LWD and RSS equipment are located below the downhole drilling motor 410. However, the RSS could run without the LWD equipment, or the LWD equipment could be run without the RSS. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, sixth paragraph for any limitations of any of the claims herein, except for those in which the claim expressly uses the words 'means for' together with an associated function.

What is claimed is:

1. A casing drilling bottom hole assembly (BHA) comprising:

a modulator and power generation system coupled to a casing;

a wireless connection coupled to a downhole end of the modulator and power generation system for providing at least one of power and data connectivity between the modulator and power generation system and a drilling motor; and a rotary steerable system (RSS) coupled to the drilling motor for receiving one of power and data communications from the modulator and power generation system via the wireless connection and the drilling motor;

the wireless connection comprising:

a first coil located within a second cylindrical coil;

the coils are coupled such that: $k=M/\sqrt{L_1L_2}\leq 0.9$, wherein k is the coupling coefficient of the coils, M is the mutual inductance between the coils, and $L_1$ and $L_2$ are the self-inductances of the respective coils;

each coil is resonantly tuned with a capacitor such that: $f_1 \approx f_2$, wherein $$f_1 = \frac{1}{2\pi\sqrt{L_1C_1}} \text{ and } f_2 = \frac{1}{2\pi\sqrt{L_2C_2}}$$

and $f_1$ and $f_2$ are the frequencies in Hertz of the respective coils, $L_1$ and $L_2$ are the self-inductances of the respective coils, and $C_1$ and $C_2$ are capacitances of tuning capacitors associated with the respective coils; and the coils have an associated figure of merit, U, such that:

$$U = k\sqrt{Q_1Q_2} \geq 3, \text{ wherein } Q_1 = \frac{2\pi f_1 L_1}{R_1} \text{ and } Q_2 = \frac{2\pi f_2 L_2}{R_2}$$

and Q1 and Q2 are the quality factors associated with the respective coils, $f_1$ and $f_2$ are the frequencies in Hertz of the respective coils, $L_1$ and $L_2$ are the self-inductances of the respective coils, and $R_1$ and $R_2$ are the resistances of the respective coils.

2. The casing drilling bottom hole assembly of claim 1, wherein the modulator and power generation system has an impedance as a source, $R_S$ wherein the impedance is governed by the equation:

$$R_S \approx R_1\sqrt{1+k^2Q_1Q_2},$$

wherein $R_1$ is the series resistance of the first coil, k is the coupling coefficient of the pair of coils, $Q_1$ is the quality factor associated with the first coil and $Q_2$ is the quality factor associated with the second coil.

3. The casing drilling bottom hole assembly of claim 1, further comprising approximately matching an impedance of the rotary steerable system (RSS) (414) $R_L$ with an impedance of the source by setting:

$$R_L \approx R_2\sqrt{1+k^2Q_1Q_2},$$

wherein $R_2$ is the series resistance of the second coil, k is the coupling coefficient of the pair of coils, $Q_1$ is the quality factor associated with primary coil and $Q_2$ is the quality factor associated with the second coil.

4. The casing drilling bottom hole assembly of claim 1, wherein the second coil comprises a wire wrapped on a core comprised of ferrite.

5. The casing drilling bottom hole assembly of claim 1, wherein the first coil comprises a wire wrapped on a cylinder comprised of ferrite.

6. The casing drilling bottom hole assembly of claim 1, further comprising a drill bit assembly coupled to the RSS.

7. The casing drilling bottom hole assembly of claim 1, further comprising a logging-while-drilling (LWD) module located below the drilling motor.

8. The casing drilling bottom hole assembly of claim 1, wherein the modulator and power generation system comprises a rotary pressure pulse generator.

9. The casing drilling bottom hole assembly of claim 1, wherein the modulator and power generation system comprises a direction & inclination (D&I) survey sensor package.

10. A casing drilling bottom hole assembly (BHA) comprising:

a modulator and power generation system coupled to a casing; and a wireless connection coupled to a downhole end of the modulator and power generation system for providing at least one of power and data connectivity between the modulator and power generation system and a drilling motor;

the wireless connection comprising:

a first coil located within a second cylindrical coil;

the coils are coupled such that: $k=M/\sqrt{L_1L_2}\leq 0.9$, wherein k is the coupling coefficient of the coils, M is the mutual inductance between the coils, and $L_1$ and $L_2$ are the self-inductances of the respective coils;

each coil is resonantly tuned with a capacitor such that: $f_1 \approx f_2$, wherein $$f_1 = \frac{1}{2\pi\sqrt{L_1C_1}} \text{ and } f_2 = \frac{1}{2\pi\sqrt{L_2C_2}}$$

and $f_1$ and $f_2$ are the frequencies in Hertz of the respective coils, $L_1$ and $L_2$ are the self-inductances of the respective coils, and $C_1$ and $C_2$ are capacitances of tuning capacitors associated with the respective coils; and the coils have an associated figure of merit, U, such that:

$$U = k\sqrt{Q_1Q_2} \geq 3, \text{ wherein } Q_1 = \frac{2\pi f_1L_1}{R_1} \text{ and } Q_2 = \frac{2\pi f_2L_2}{R_2}$$

and Q1 and Q2 are the quality factors associated with the respective coils, $f_1$ and $f_2$ are the frequencies in Hertz of the respective coils, $L_1$ and $L_2$ are the self-inductances of the respective coils, and $R_1$ and $R_2$ are the resistances of the respective coils.

11. The casing drilling bottom hole assembly of claim 10, further comprising a rotary steerable system (RSS) coupled to the drilling motor for receiving one of power and data communications from the modulator and power generation system via the wireless connection and the drilling motor.

12. The casing drilling bottom hole assembly of claim 10, wherein the rotary modulator and power generation system generates mud pulses based on energy from mud flow and operates simultaneously with a pump that produces mud flow through the modulator and turbine power generation system.

13. The casing drilling bottom hole assembly of claim 12, wherein the mud pulses have a frequency between about 1 bit/second and about 12 bits/second.

14. The casing drilling bottom hole assembly of claim 13, wherein the rotary modulator and power generation system has a mud pulse telemetry range of at least between about 20,000 feet to about 50,000 feet with casing having about a 7.0 inch diameter and signal strength of about 1.0 psi at a surface.

15. A casing drilling bottom hole assembly (BHA) comprising:

a modulator and power generation system coupled to a casing; and a wireless connection coupled to a downhole end of the modulator and power generation system for providing at least power between the modulator and power generation system and a drilling motor, the rotary modulator and power system generates mud pulses based on energy from mud flow and operates simultaneously with a pump that produces mud flow through the modulator and power generation system wherein the wireless connection comprises:

a first coil located within a second coil;

the coils are coupled such that: $k=M/\sqrt{L_1L_2}\leq 0.9$, wherein k is the coupling coefficient of the coils, M is the mutual inductance between the coils, and $L_1$ and $L_2$ are the self-inductances of the respective coils;

each coil is resonantly tuned with a capacitor such that: $f_1 \approx f_2$, wherein $$f_1 = \frac{1}{2\pi\sqrt{L_1C_1}} \text{ and } f_2 = \frac{1}{2\pi\sqrt{L_2C_2}}$$

and $f_1$ and $f_2$ are the frequencies in Hertz of the respective coils, $L_1$ and $L_2$ are the self-inductances of the respective coils, and $C_1$ and $C_2$ are capacitances of tuning capacitors associated with the respective coils; and the coils have an associated figure of merit, U, such that:

$$U = k\sqrt{Q_1Q_2} \geq 3, \text{ wherein } Q_1 = \frac{2\pi f_1L_1}{R_1} \text{ and } Q_2 = \frac{2\pi f_2L_2}{R_2}$$

and Q1 and Q2 are the quality factors associated with the respective coils, $f_1$ and $f_2$ are the frequencies in Hertz of the respective coils, $L_1$ and $L_2$ are the self-inductances of the respective coils, and $R_1$ and $R_2$ are the resistances of the respective coils.

* * * * *